US010193271B2

(12) United States Patent
Yu et al.

(10) Patent No.: US 10,193,271 B2
(45) Date of Patent: Jan. 29, 2019

(54) ELECTRICAL CONNECTOR HAVING METALLIC OUTER COVER EQUIPPED WITH TRANSVERSELY LINKED MOUNTING EARS AND SEALING ELEMENT SECURED UPON FRONT END REGION

(71) Applicant: FOXCONN INTERCONNECT TECHNOLOGY LIMITED, Grand Cayman (KY)

(72) Inventors: Yang-Yang Yu, Huaian (CN); Jin-Guo Qiu, Huaian (CN); Shao-Cong Zhou, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/831,198

(22) Filed: Dec. 4, 2017

(65) Prior Publication Data

US 2018/0159266 A1 Jun. 7, 2018

(30) Foreign Application Priority Data

Dec. 2, 2016 (CN) ..... 2016 1 1099544

(51) Int. Cl.

| | |
|---|---|
| ***H01R 13/648*** | (2006.01) |
| ***H01R 13/52*** | (2006.01) |
| ***H01R 12/58*** | (2011.01) |
| ***H01R 12/72*** | (2011.01) |
| ***H01R 13/506*** | (2006.01) |
| ***H01R 12/70*** | (2011.01) |
| ***H01R 13/6594*** | (2011.01) |
| *H01R 13/405* | (2006.01) |
| *H01R 24/60* | (2011.01) |

(52) U.S. Cl.

CPC ..... *H01R 13/5219* (2013.01); *H01R 12/58* (2013.01); *H01R 12/7047* (2013.01); *H01R 12/724* (2013.01); *H01R 13/506* (2013.01); *H01R 13/6594* (2013.01); *H01R 13/405* (2013.01); *H01R 24/60* (2013.01)

(58) Field of Classification Search

CPC ..... H01R 13/6595
USPC ..... 439/607.3, 607.37, 607.4, 559, 556, 939
See application file for complete search history.

(56) References Cited

U.S. PATENT DOCUMENTS

| | | | | |
|---|---|---|---|---|
| 7,081,012 | B2 * | 7/2006 | Gensert | B60K 15/03 174/151 |
| 9,088,095 | B2 * | 7/2015 | Yokoyama | H01R 13/60 |
| 9,425,560 | B1 * | 8/2016 | Su | H01R 13/6591 |

FOREIGN PATENT DOCUMENTS

| | | |
|---|---|---|
| CN | 204315812 | 5/2015 |
| CN | 204616260 | 9/2015 |
| CN | 204651582 | 9/2015 |
| CN | 205159615 | 4/2016 |

* cited by examiner

*Primary Examiner* — Phuong Dinh
(74) *Attorney, Agent, or Firm* — Wei Te Chung; Ming Chieh Chang

(57) ABSTRACT

An electrical connector includes: an insulative housing having a base portion and a tongue portion; plural contacts affixed to the insulative housing and exposed to the tongue portion; an outer cover enclosing the insulative housing, the outer cover having plural peripheral grooves (111) open at a front face thereof; and a sealing element having plural protrusions (421) secured to the plural grooves.

6 Claims, 13 Drawing Sheets

ELECTRICAL CONNECTOR HAVING METALLIC OUTER COVER EQUIPPED WITH TRANSVERSELY LINKED MOUNTING EARS AND SEALING ELEMENT SECURED UPON FRONT END REGION

BACKGROUND OF THE INVENTION

1. Field of the Invention

The present invention relates to an electrical connector including a contact module, a metallic outer cover enclosing the contact module with mounting ears thereof, and a sealing element secured to the metallic outer cover by way of a dovetail structure. This application relates to a copending application having the same filing date, the same applicant and one same inventor with a title of "ELECTRICAL CONNECTOR HAVING AN INSULATIVE OUTER COVER AND A SEALING MEMBER SECURED TO THE OUTER COVER VIA A DOVETAIL STRUCTURE".

2. Description of Related Arts

China Patent No. 205159615 discloses an electrical connector comprising electrical connector comprising: an insulative housing having a base portion and a tongue portion; a plurality of contacts affixed to the insulative housing and exposed to the tongue portion; s shielding shell enclosing the insulative housing; an insulative outer cover enclosing the shielding shell and having a front annular groove; and a sealing element formed in the groove.

SUMMARY OF THE INVENTION

An electrical connector comprises: an insulative housing having a base portion and a tongue portion; a plurality of contacts affixed to the insulative housing and exposed to the tongue portion; a metallic outer cover enclosing the insulative housing and forming a mating cavity, for receiving a plug connector, in which the tongue portion forwardly extend and further out of the mating cavity with a distance, the outer cover having a plurality of peripheral grooves open at a front face thereof; and a sealing element having a plurality of protrusions secured to the plurality of grooves. The metallic outer cover includes a pair of mounting ears which are aligned with and located by two opposite sides of the mating cavity in the transverse direction. The mounting ear is unitarily linked with the metallic outer cover via a linking region which is aligned with the mating cavity in the transverse direction.

DETAILED DESCRIPTION OF THE PREFERRED EMBODIMENT

Figure 1:
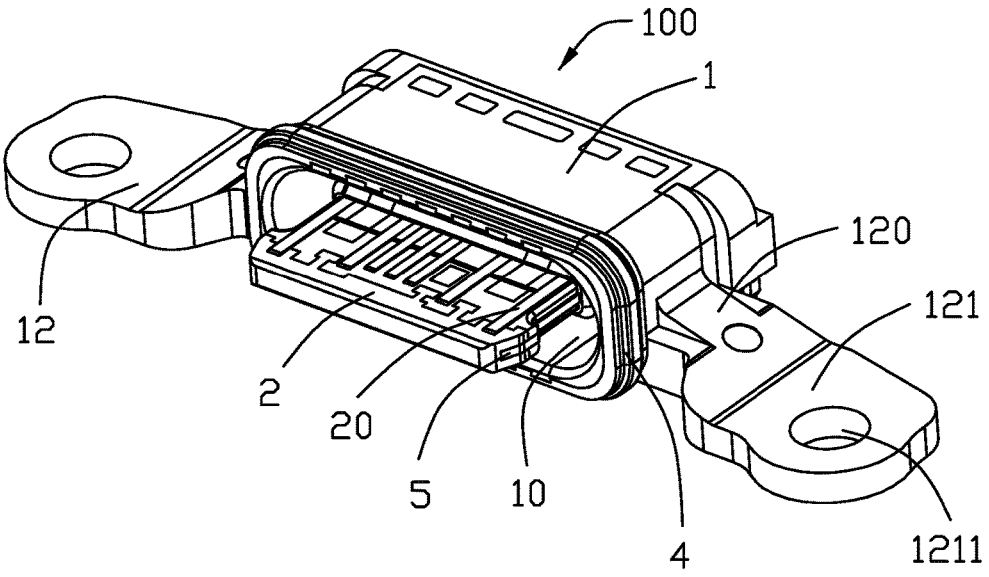
FIG. 1 is a perspective view of an electrical connector in accordance with a first embodiment of the present invention.

Referring to FIGS. 1-10, an electrical connector 100 for mounting to a printed circuit board comprises a metallic outer cover 1 having a receiving space 10, a contact module 2 received in the receiving space 10 of the outer cover 1, and a sealing element 4 secured to a front of the outer cover 1. The electrical connector 100 may further include a sealing member 3 at a rear of the outer cover 1.

Referring specifically to FIGS. 1 and 5-10, the outer cover 1 includes a tubular main portion 11 and a pair of side arms 12. The outer cover 1 may be metallic or plastic and preferably is formed by metal injection molding process. One of the outer cover 1 and the sealing element 4 has at least one groove and the other has at least one corresponding protrusion. Preferably, the outer cover 1 has plural grooves 111 and the sealing element 4 has plural protrusions 421. The grooves 111 are formed at an exterior wall face 1101 of a front end (region) 110 of the outer cover 1 and each extend in a front-and-back direction. The grooves 111 are equidistant to form dividers 112. The peripheral grooves 111 are open at a front face 1102 of the outer cover 1. The groove 111 has a bottom 1111 and a top opening 1114. The groove 111 has a trapezoidal shape with inclined side faces 1112 and 1113 so that a width of the bottom is greater than a width of the top opening, which prevents the sealing element 4 from falling off. The grooves 111 are provided at an upper and lower sides of the front end 110; each groove has a greater dimension in the front-and-back direction than in a left-and-right dimension. At a left and right sides of the front end 110 are provided two larger grooves without any divider. If desired, dividers may be provided at the left and right sides of the outer cover front end 110. The arm 12 has a mounting portion or mounting ear 121 and a connecting portion or linking region 120 linked to the tubular main portion 11. The mounting portion 121 has a hole 1211 for a fastener. The connecting portion 121 has a tapered structure for reinforcing.

Referring specifically to FIGS. 5-10, the sealing element 4 is formed by molding, curing or solidifying, a suitable material at the front end 110. The sealing element 4 includes an exterior surface 41, an interior wall face 42, and the plural protrusions 421 formed at the interior wall face. The protrusions 421 are equidistant to form channels 422. The exterior surface 41 has various ridges for effective waterproof function. The protrusion 421 has a bearing face 4211 for abutting against the bottom 1111 of the outer cover groove 111 and two inclined side faces 4212 and 4213 for abutting against the inclined side faces 1112 and 1113.

Referring specifically to FIGS. 2-6, the contact module 2 includes an insulative body 22, plural contacts 20 fixed to the body 22, an over-mold body 21 molded to the combination of body 22 and contacts 20, and a pair of metal pieces 5. The over-mold body 21 has a base 211 and a tongue 212.

The tongue 212 has a receiving part 2121 and two side parts 2122. The insulative body 22 and the over-mold body 21 commonly form an insulative housing composed of the base portion and the tongue portion. The insulative body 22 has an upper surface 222, a lower surface 223, contact receiving slots 224, and a pair of side securing parts 221. The contacts are arranged as an upper and lower rows of contacts 23 and 24. Each upper contact 23 has a contacting portion 231, a soldering portion 233, and a connecting portion 232; each lower contact 24 has a contacting portion 241, a soldering portion 243, and a connecting portion 242. The soldering portions 233 and 243 extend through the rear sealing member 3 and arranged in a line. Notably, the tubular main portion 11 of the outer cover 1 forms a mating cavity (not labeled) in front of the base 211, and such a mating cavity is a part of the receiving space 10.

Figure 2:
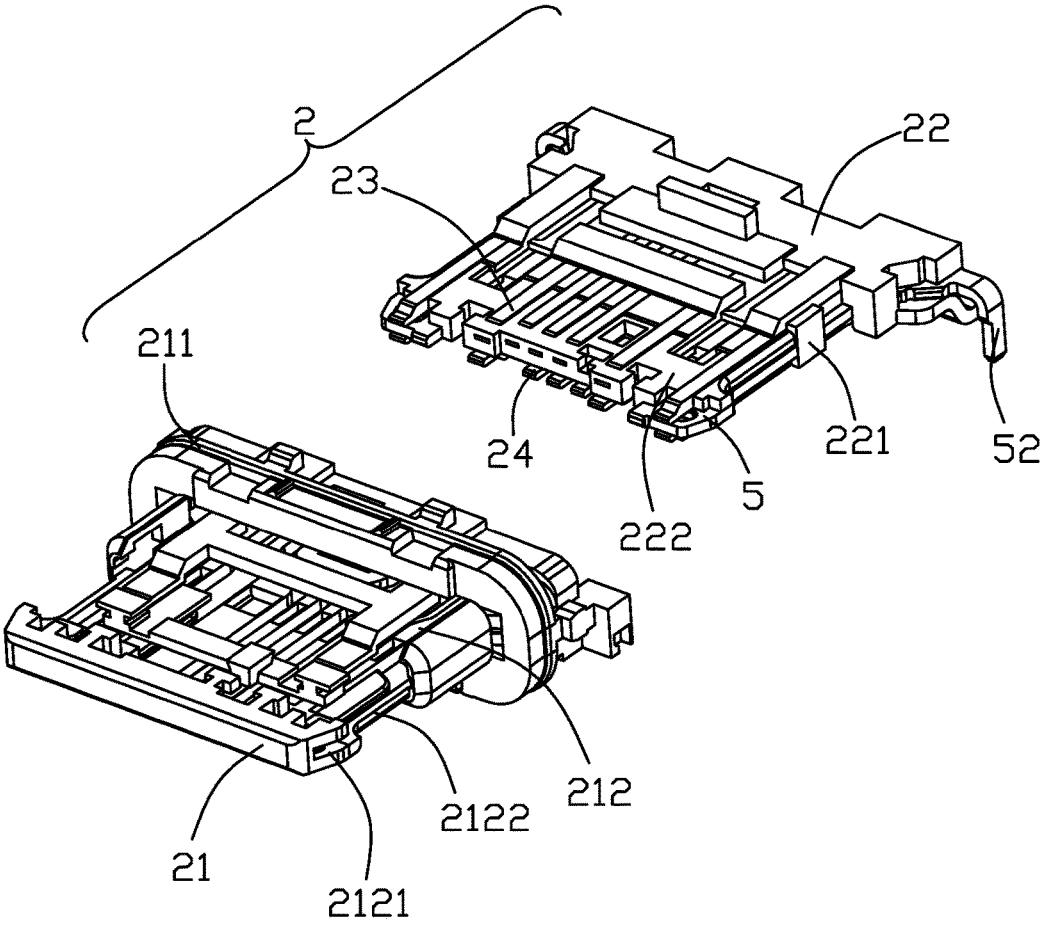
FIG. 2 is an exploded view of a contact module of the electrical connector.
Figure 3:
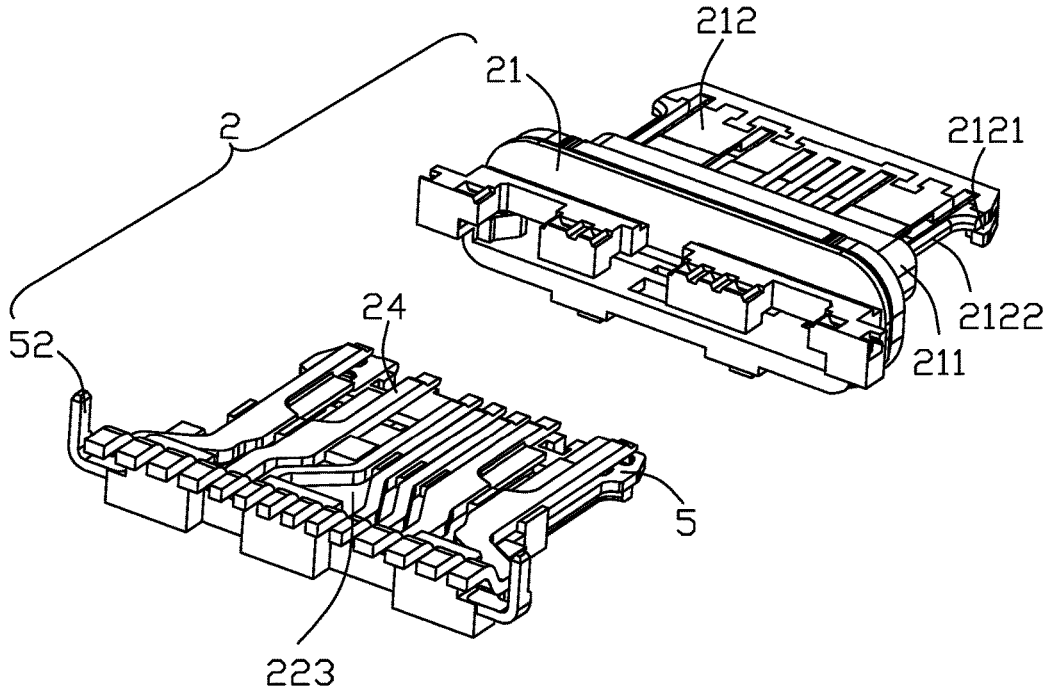
FIG. 3 is a view similar to FIG. 2 but from a different perspective.
Figure 4:
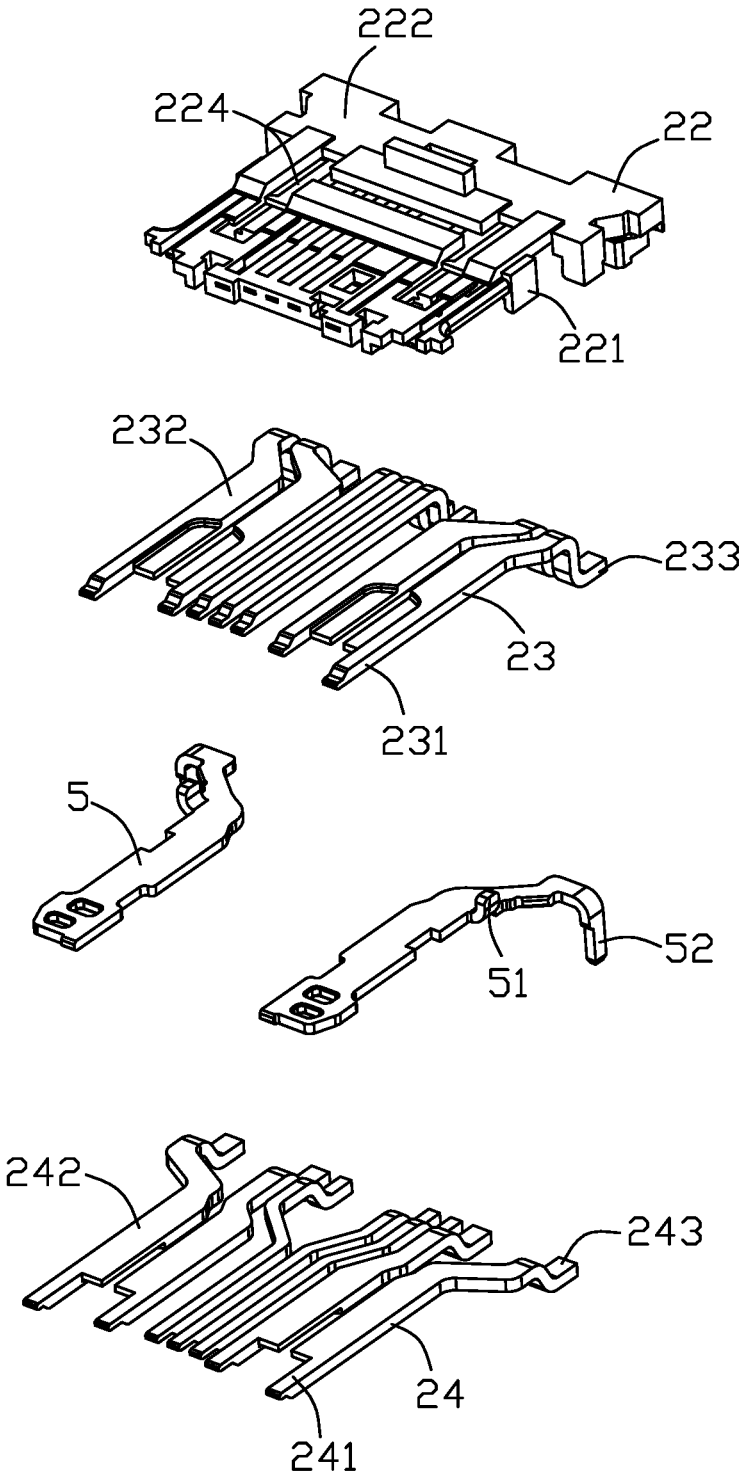
FIG. 4 is a further exploded view of the contact module omitting an over-mold body thereof.

Referring specifically to FIGS. 2-4, the metal pieces 5 are secured to the insulative body 22 between the upper row of contacts 23 and the lower row of contacts 24. The metal piece 5 has a fixture 51 and a soldering or mounting leg 52.

Figure 5:
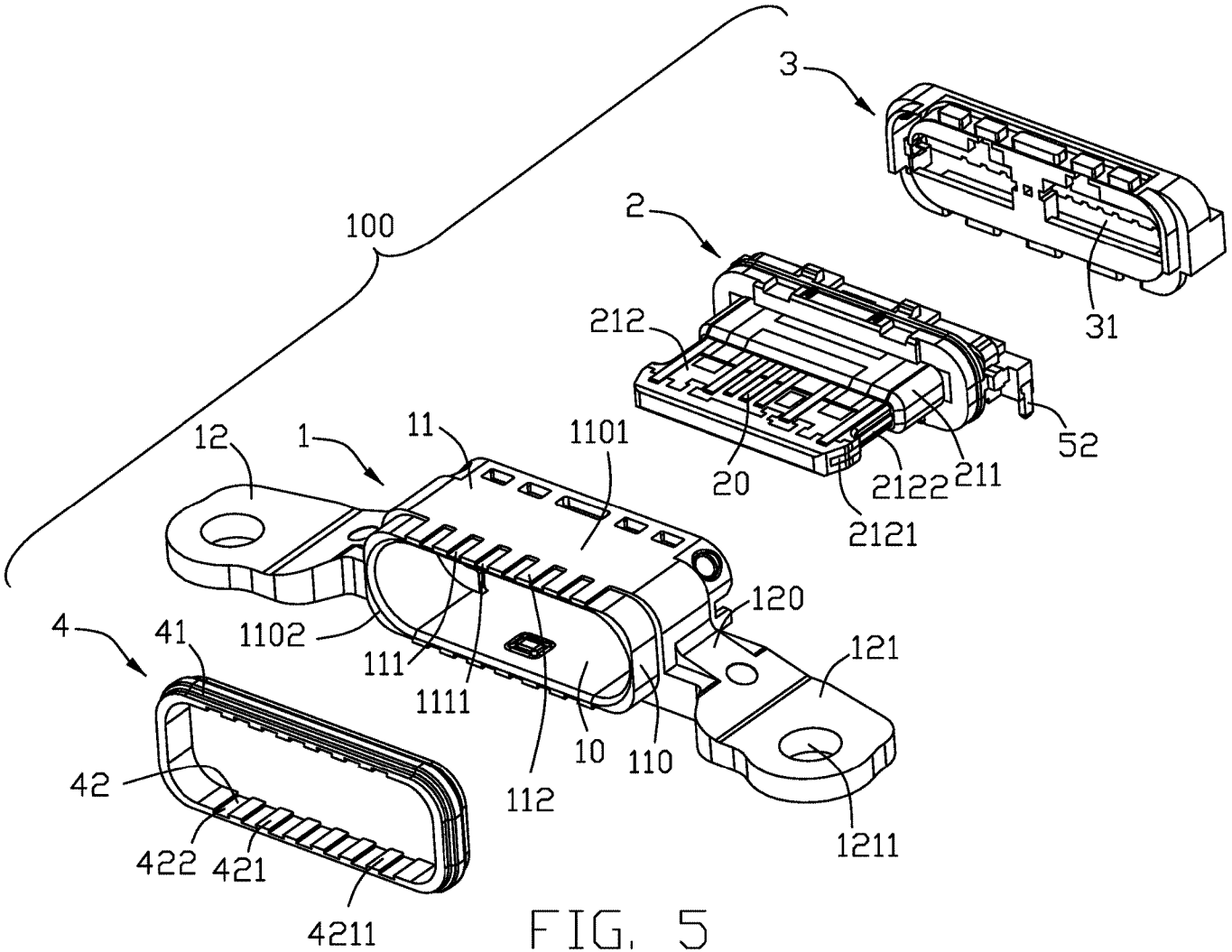
FIG. 5 is an exploded view of the electrical connector.
Figure 6:
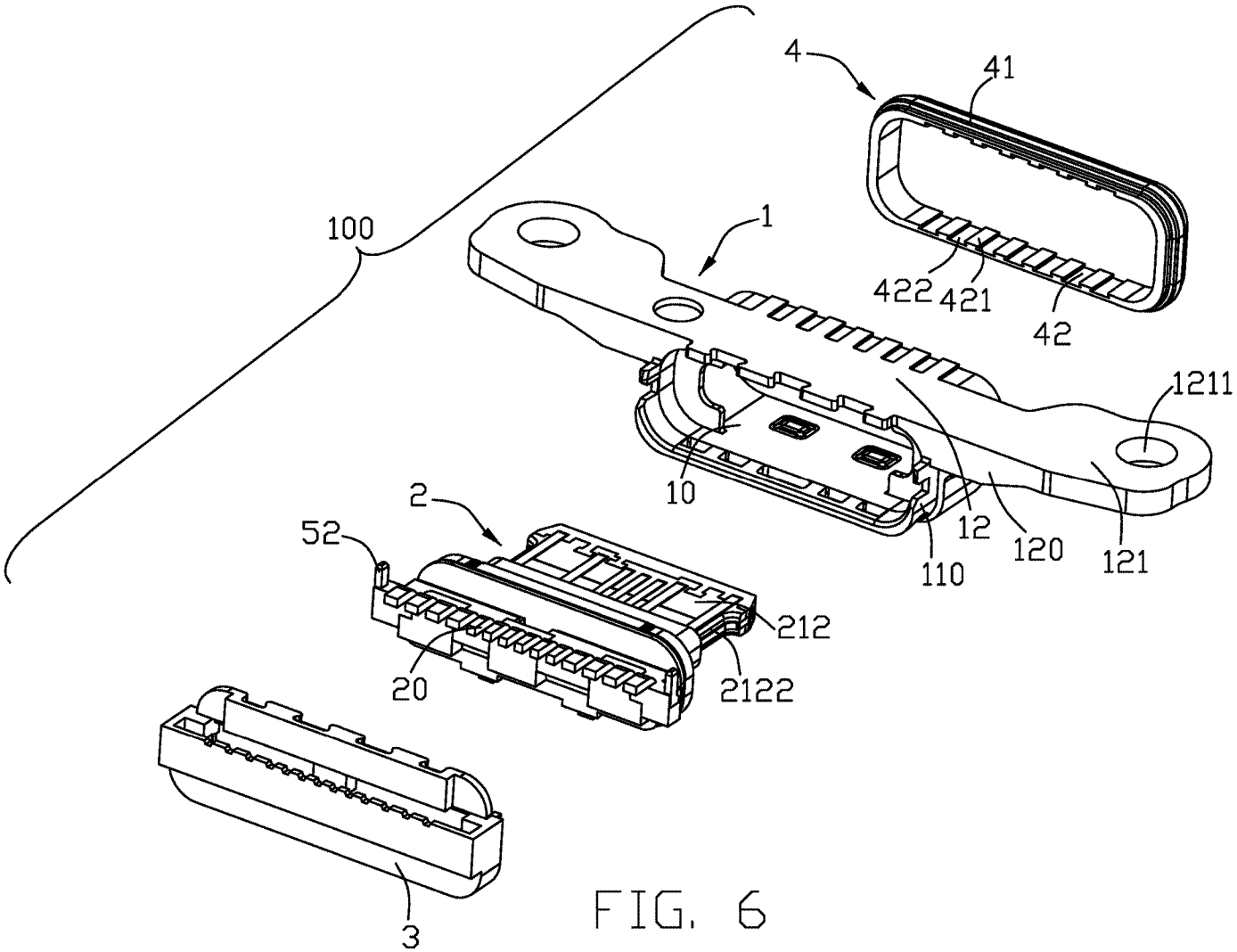
FIG. 6 is a view similar to FIG. 5 but from a different perspective.
Figure 7:
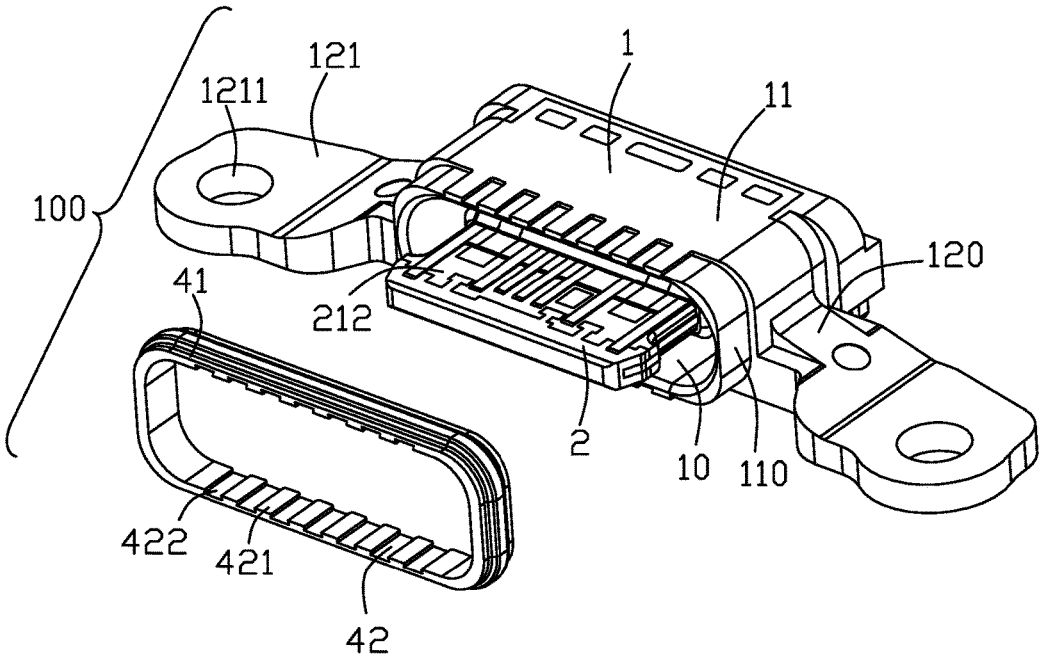
FIG. 7 is another exploded view of the electrical connector.
Figure 8:
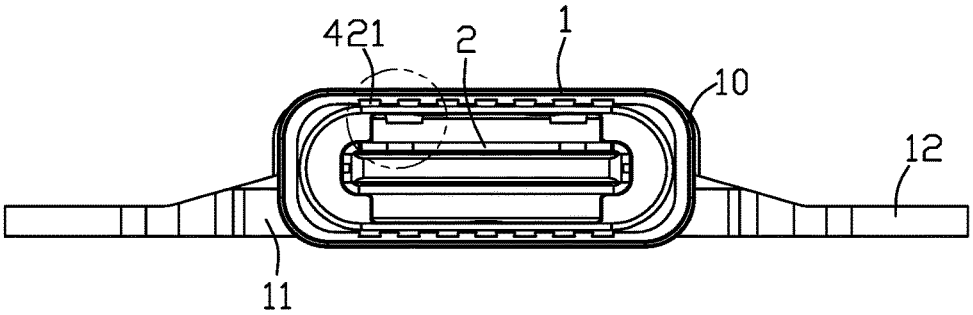
FIG. 8 is a front view of the electrical connector.
Figure 9:
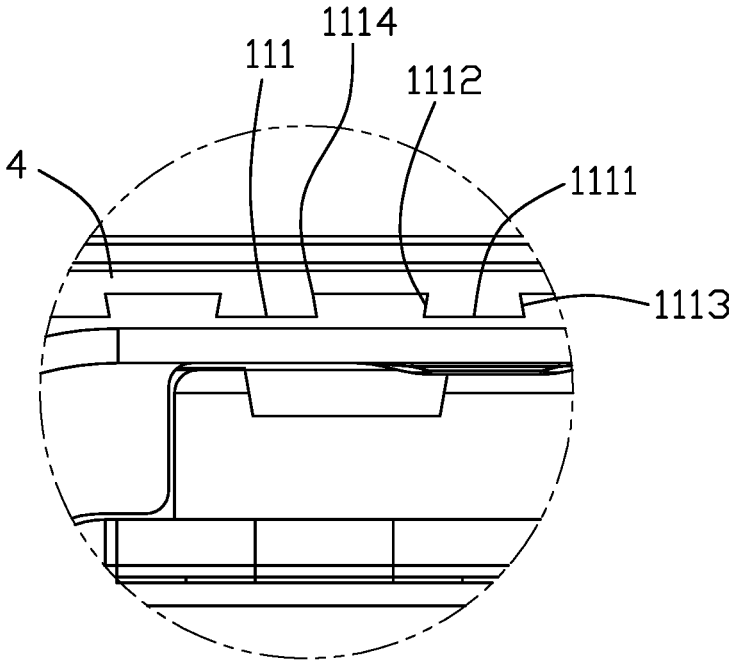
FIG. 9 is an enlarged view of the circled portion in FIG. 8.
Figure 10:
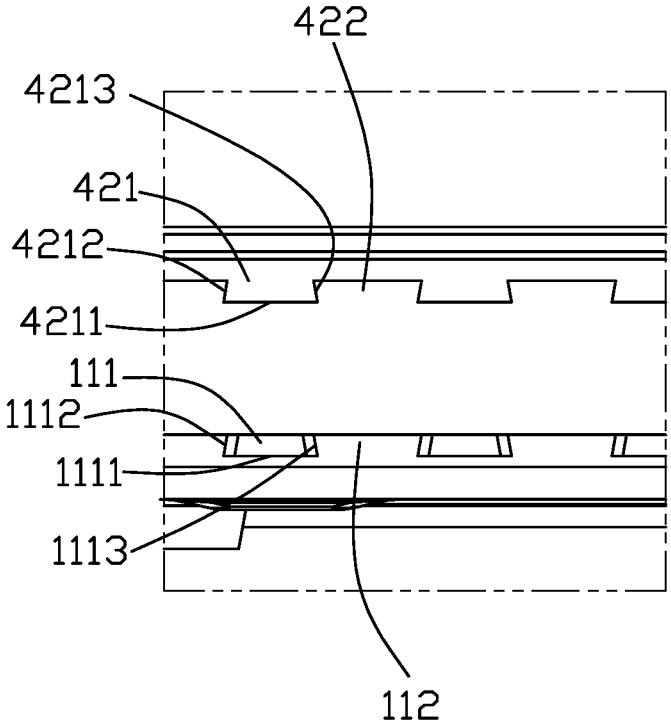
FIG. 10 is a view similar to FIG. 9 but showing a sealing element and an outer cover of the electrical connector not assembled yet.

Referring specifically to FIGS. 4-6, the rear sealing member 3 is injection molded from plastic materials and has a row of holes 31 through which the soldering portions 233 and 243 extend.

The provision of a dovetail structure between the outer cover 1 and the sealing element 4 ensures a firm securement and achieves an effective water-proof function with a housing opening of an electronic device the electrical connector 100 is installed. Another feature of the invention is to have the tongue 212 extends through the mating cavity and further out of the mating cavity with a distance, and the connecting portion 120 is aligned with the mating cavity in the transverse direction so as to assure stability of the mating cavity during mating compared with some related arts in which the mounting ears are spaced from the tubular main portion without any connecting portion therebetween in alignment with the mating cavity in the transverse direction.

Figure 11:
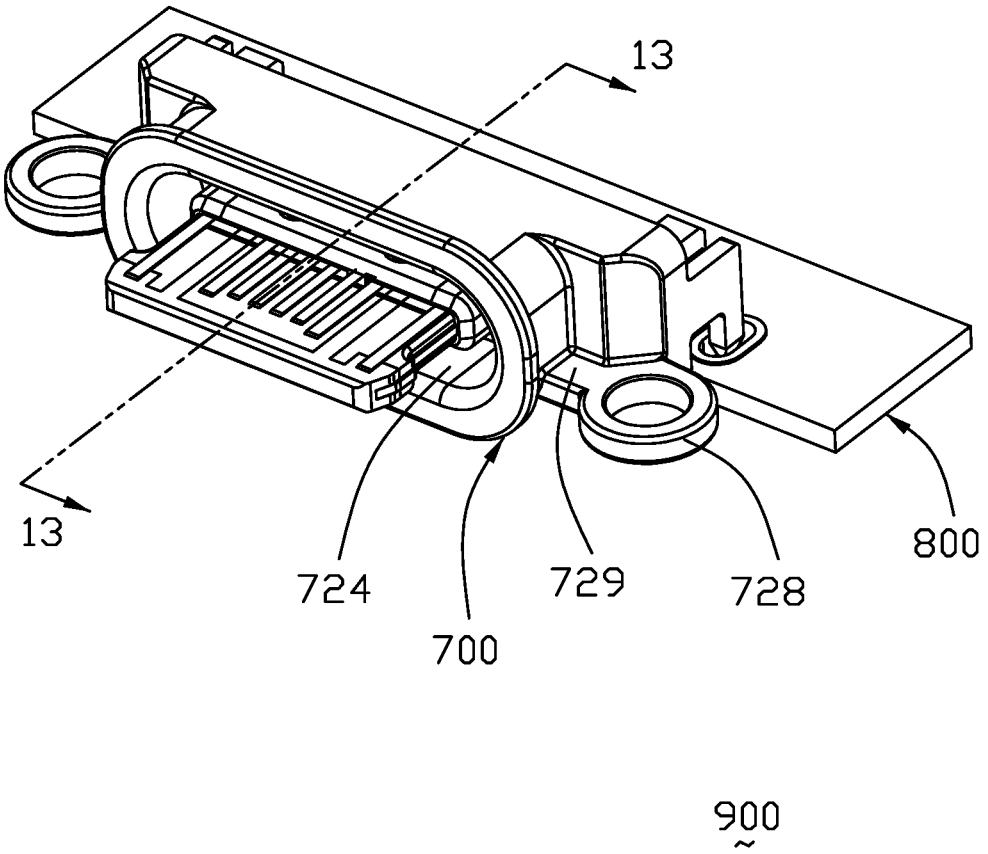
FIG. 11 is a perspective view of an electrical connector according to a second embodiment of the invention.
Figure 12:
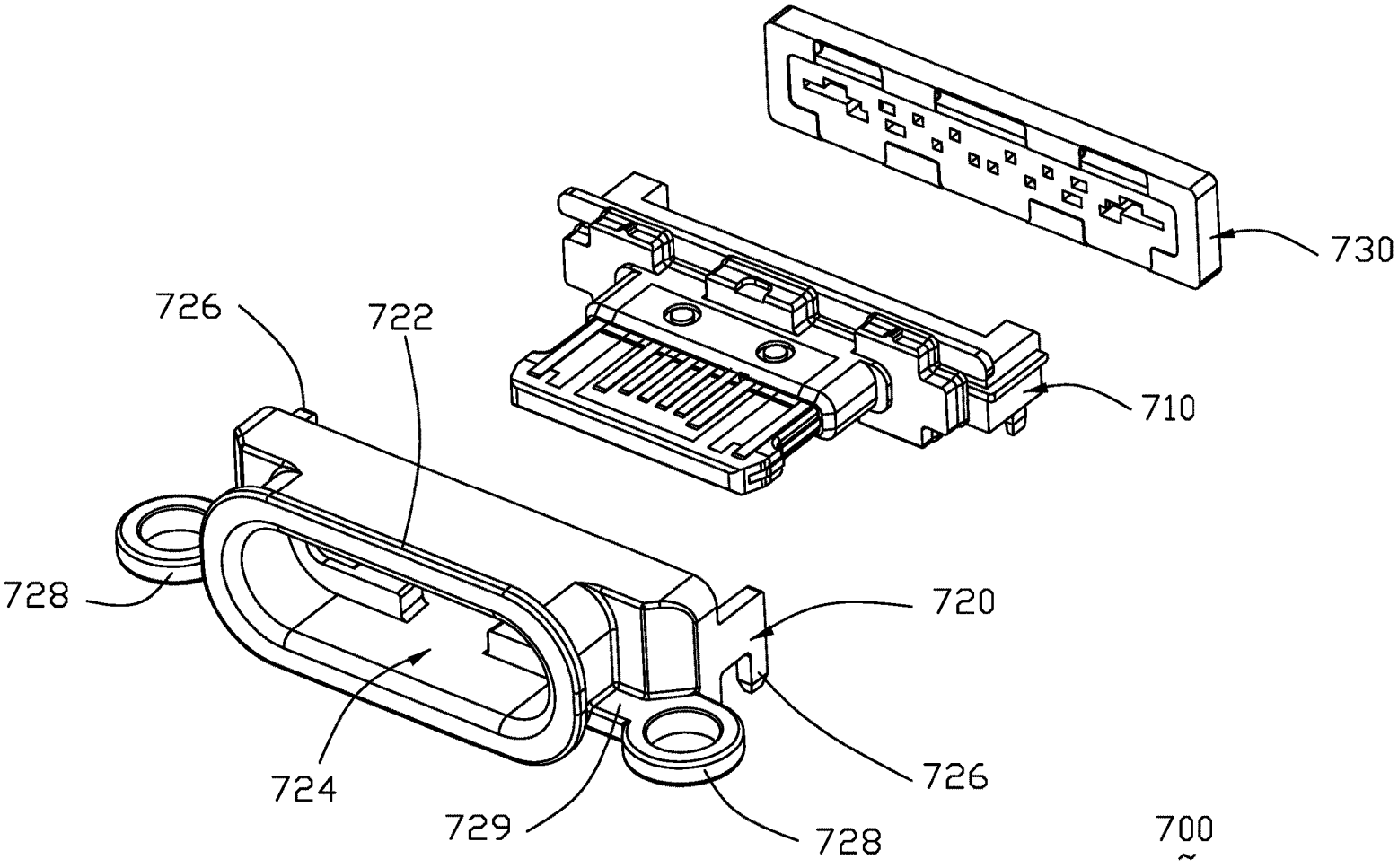
FIG. 12 is an exploded perspective view of the electrical connector of FIG. 11.
Figure 13:
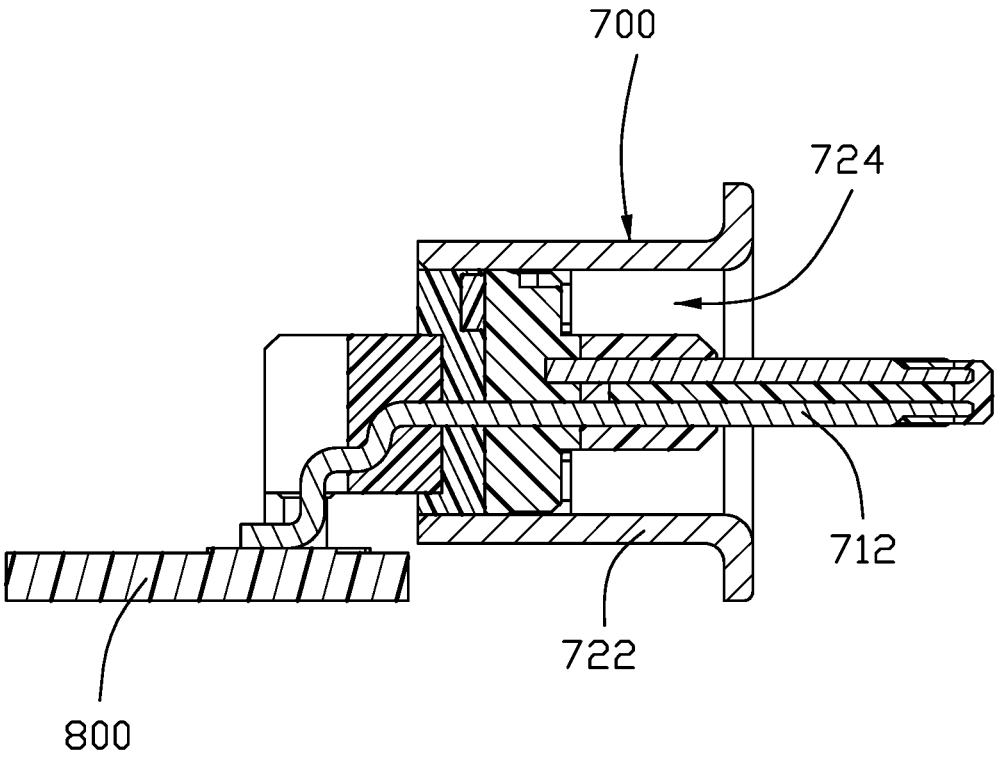
FIG. 13 is a cross-sectional view of the electrical connector of FIG. 11.

FIGS. 11-13 show an electrical connector assembly 900 including an electrical connector 700 mounted upon the printed circuit board 800 wherein the electrical connector 700 includes a metallic outer cover 720 enclosing both a contact module 710 and a rear sealing member 730 which is located behind the contact module 710. The metallic outer cover 720 includes elliptic tubular main portion 722 forming therein a mating cavity 724 in which a tongue portion 712 of the contact module 710 forwardly extends, a pair of mounting legs 726 for mounting to the printed circuit board 800, and a pair of mounting ears 728 located in front of the corresponding mounting legs 726 in the front-to-back direction and beside the mating cavity 724 and in front of the printed circuit board 800 for securing with a fastener. Each mounting ear 728 is linked, via a connecting portion 729, to the elliptic tubular main portion 722 in the transverse direction perpendicular to the front-to-back direction so as to provide a reliable support for the mating cavity 724 during mating. Notably, the mounting ear 728 and the corresponding connecting portion 729 commonly form a side arm (not labeled) as illustrated in the first embodiment. A front sealing element (not shown) is optionally attached to a front end region of the outer cover 720 as illustrated in the first embodiment.

What is claimed is:

1. An electrical connector comprising:

an insulative housing having a base portion and a tongue portion;

a plurality of contacts affixed to the insulative housing and exposed to the tongue portion;

an outer cover enclosing the insulative housing, the outer cover having a plurality of peripheral grooves open at a front face thereof; and a sealing element having a plurality of protrusions secured to the plurality of grooves, wherein said contacts are assembled within the insulative housing to commonly form a contact module enclosed in the outer cover, wherein said outer cover is metallic, wherein said outer cover includes a tubular main portion and a pair of side arms unitarily extending outwardly from the tubular main portion in a transverse direction, wherein each of said side arms including a mounting ear linked to the tubular main portion via a connecting portion in the transverse direction.

2. The electrical connector as claimed in claim 1, wherein the groove has a trapezoidal shape.

3. An electrical connector comprising:

a contact module including a plurality of contacts retained in an insulative housing, said housing including a base and a tongue portion extending forwardly from the base along a front-to-back direction;

a metallic outer cover enclosing the contact module and including an elliptic tubular main portion and a pair of side arms unitarily extending from two opposite sides of the main portion in a transverse direction perpendicular to the front-to-back direction, the elliptic tubular main portion defining a mating cavity in which the tongue portion extends forwardly along the front-to-back direction and further out of the mating cavity; and a front sealing element surrounding a front end region of the outer cover; wherein each of said side arms is aligned with the mating cavity in the transverse direction, and includes a mounting ear having a hole therein and linked to the elliptic tubular main portion via a corresponding connecting portion, wherein said outer cover further includes a pair of mounting legs respectively located behind the pair of mounting ears, respectively, in the front-to-back direction, wherein said connecting portion is tapered in a vertical direction perpendicular to both the front-to-back direction and the transverse direction, wherein said front sealing element includes a plurality of protrusions respectively snugly engaged within corresponding grooves formed in the front end region.

4. The electrical connector as claimed in claim 3, wherein a cross-section of the groove is trapezoidal.

5. An electrical connector assembly comprising:

a printed circuit board;

an electrical connector including:

a pair of mounting legs secured to the printed circuit board;

a contact module including a plurality of contacts retained in an insulative housing, said housing including a base and a tongue portion extending forwardly from the base along a front-to-back direction; and a metallic outer cover enclosing the contact module and including an elliptic tubular main portion and a pair of side arms unitarily extending from two opposite sides of the main portion in a transverse direction perpendicular to the front-to-back direction, the elliptic tubular main portion defining a mating cavity in which the tongue portion extends forwardly along the front-to-back direction and further out of the mating cavity; wherein each of said side arms is located in front of the corresponding mounting legs in the front-to-back direction and aligned with the mating cavity in the transverse direction, and includes a mounting ear having a hole therein and linked to the elliptic tubular main portion via a corresponding connecting portion, wherein the mounting legs are formed by the metallic outer cover, wherein the contacts are arranged in two rows, and the mounting legs are formed by a pair of metal pieces sandwiched between the said two rows of contacts in a vertical direction perpendicular to both the front-to-back direction and the transverse direction, further including a sealing element around a front end region of the outer cover, wherein said sealing element includes a plurality of protrusions snugly received within corresponding grooves formed in the front end region of the outer cover.

6. The electrical connector assembly as claimed in claim 5, wherein a cross-section of the groove is trapezoidal.

* * * * *